United States Patent [19]

Richards et al.

[11] Patent Number: 4,617,456

[45] Date of Patent: Oct. 14, 1986

[54] LONG LIFE CORROSION PROOF ELECTROPLATING IMMERSION HEATER

[75] Inventors: Tom Richards, Mentor; Raymond S. Lokar, Cleveland, both of Ohio

[73] Assignee: Process Technology, Inc., Mentor, Ohio

[21] Appl. No.: 651,856

[22] Filed: Sep. 18, 1984

[51] Int. Cl.[4] ..... H05B 3/78; H05B 3/48

[52] U.S. Cl. ..... 219/523; 219/306; 219/316; 219/318; 219/335; 219/534; 219/544

[58] Field of Search ..... 219/306, 307, 310, 312, 219/314, 316, 318, 319-321, 335, 336, 523

[56] References Cited

U.S. PATENT DOCUMENTS

| | | | |
|---|---|---|---|
| 2,708,233 | 5/1955 | Moore | 219/319 X |
| 3,657,520 | 4/1972 | Ragault | 219/553 |
| 3,663,799 | 5/1972 | McArn | 219/335 X |
| 3,673,386 | 6/1972 | Drugmand et al. | 219/335 X |
| 3,674,985 | 7/1972 | Ragault | 219/523 |
| 4,068,116 | 1/1978 | McKinstry | 219/318 X |
| 4,158,764 | 6/1979 | Yane | 219/549 X |

FOREIGN PATENT DOCUMENTS

| | | | |
|---|---|---|---|
| 2336472 | 2/1975 | Fed. Rep. of Germany | 219/335 |

*Primary Examiner*—A. Bartis

*Attorney, Agent, or Firm*—John P. Hazzard

[57] ABSTRACT

A flexible electric heating assembly for immersion heating of highly corrosive liquids, such as electroplating solutions, includes an iron-nickel-chronium resistance element disposed within a thin-walled stainless steel tube and electrically insulated therefrom by a magnesium oxide ceramic. The tube is enclosed in a tubular casing in direct contact with the tube and formed of resilient electrical insulating material having a low surface coefficient of friction and a high resistance to heat and attacks by corrosive liquids or vapors, e.g., polytetrafluroetylene. The ends of the tube terminate withn a non-corrosive junction box located outside the liquid to be heated, and in which box the connections between the power supply and heating element terminals are made. A wire clamping member surrounds each end of the tubular casing within the junction box and is twisted to exert a compressive force continuously around the outer casing to prevent any corrosive liquids and vapors from penetrating between the outer casing and the clamping member. The junction box is filled with an epoxy resin potting material which covers all the electrical connections, the ends of the tubular casing and clamping members, with the clamping members being receptive to the potting material so that a gas-tight seal is effected between potting material and the surfaces of the clamping members contacted thereby.

10 Claims, 7 Drawing Figures

LONG LIFE CORROSION PROOF ELECTROPLATING IMMERSION HEATER

BACKGROUND OF THE INVENTION

The present invention relates to an immersion heater for heating electroplating solutions wherein a heater tube is encased in a material having a low surface coefficient of friction and a high resistance to heat and attack by acid or alkaline solutions or vapors such as the fluorocarbon polymers, particularly polytetrafluoroethylene tubing or films. While the heater can be used for any desired purpose, it is most particularly adapted for immersion into a highly corrosive solution and/or atmosphere of an electroplating solution in a container to maintain the solution at a desired temperature during an electroplating operation.

In the design and manufacture of electrical resistance heaters for immersion in liquid baths, or immersion heaters, as they are called, it is desirable to protect the electrical heating element from any corrosive effects of the bath or the atmosphere above the bath. Likewise, it is desirable to have a high degree of flexibility to the heater tube to permit coiling and winding on supports to increase the length of heater which may be immersed in the bath. Flexible immersion heaters having an inert plastic encasing the heating element are known in the art, as for example those described in U.S. Pat. Nos. 3,674,985; 3,657,520 and 4,158,764. The first two of these mentioned patents discribe such known immersion heaters which lack the desired flexibility because of a solid linear heating element as used with a braided glass sheath covered with a coating of rubber bonded to the outer surface of the sheath. The latter of these patents, namely, U.S. Pat. No. 4,158,764 utilized a coil conductor formed from an alloy having a high electrical resistance and has an outer tubular casing of plastic material which is inert to acid or alkaline solutions. A flexible sleeve braided of fibrous glass material is slideably assembled on the coiled wire and the sleeve with coiled wire within is inserted as a subassembly into the outer tubular member to form an assembly for immersion in the liquid to be heated. A number of these prior art disclosures indicate that the plastic material protecting the resistance heater within the flexible heating tube can be polytetrafluoroethylene.

Many attempts have been made in the past to utilize a polytetrafluoroethylene outer protective coating for such immersion heaters for use in corrosive baths and/or atmospheres as found in electroplating. Initially, such heaters were found to be defective in that that the polytetrafluoroethylene (PTFE) was extremely difficult to extrude or otherwise be formed into a continuous film so as to adequately protect the resistance heating means within the heater tube. Pinholes in the PTFE allowed corrosive solutions to pass through the PTFE and relatively rapidly corrode and ruin such immersion heaters. Although today's PTFE tubing is more void free than that produced as little as five years ago, it is still defective in a number of instances due to poor tubing formation.

SUMMARY OF THE INVENTION

The present invention provides a solution to the above described problems with known immersion heaters in that it utilizes only pore free PTFE tubing as the tubular casing and further said electrical resistance heating element is further protected by a clamping means which prevents the corrosive gases above the plating solution from entering the junction box through which electrical power is delivered to the resistance heating element. In the past such a junction box was potted with a corrosion free resin potting material able to withstand the environment in which it will be utilized, such as an epoxy resin, after the necessary electrical connections were made to the heating tube. Said epoxy would cover the end of the PTFE tubing and for all intents and purposes was thought to adequately prevent corrosion of the resistance heater element. However failures still would occur and these were inadvertently blamed on the porosity of the PTFE which was the classic cause of prior failure of such electric immersion heaters. Applicants on the other hand discovered that the lifetime of such heaters could be materially increased and made more uniform by providing a positive seal between the epoxy resin and the PTFE so as to prevent gaseous materials from invading the junction box through the minute opening which would appear around the PTFE tubing due to the fact that the epoxy would not adhere thereto in a manner so as to prevent diffusion of gas through such interstices. Applicant's solution while simple is most effective. This solution is to provide a clamping means which compresses the PTFE throughout the circumference of the tube so as to produce a seal between the clamp and the PTFE tubing such that it will prevent gases from going therebetween. The clamping means is also receptive to the epoxy adhesive utilized in the potting operation and therefore makes a gas tight seal between the outer surface of the clamping device and the epoxy resin thus effectively eliminating any gaseous intrusion between the PTFE and the epoxy which heretofore resulted in corrosion and destruction of such electrical immersion heaters.

DETAILED DESCRIPTION OF THE DRAWINGS

Figure 1:
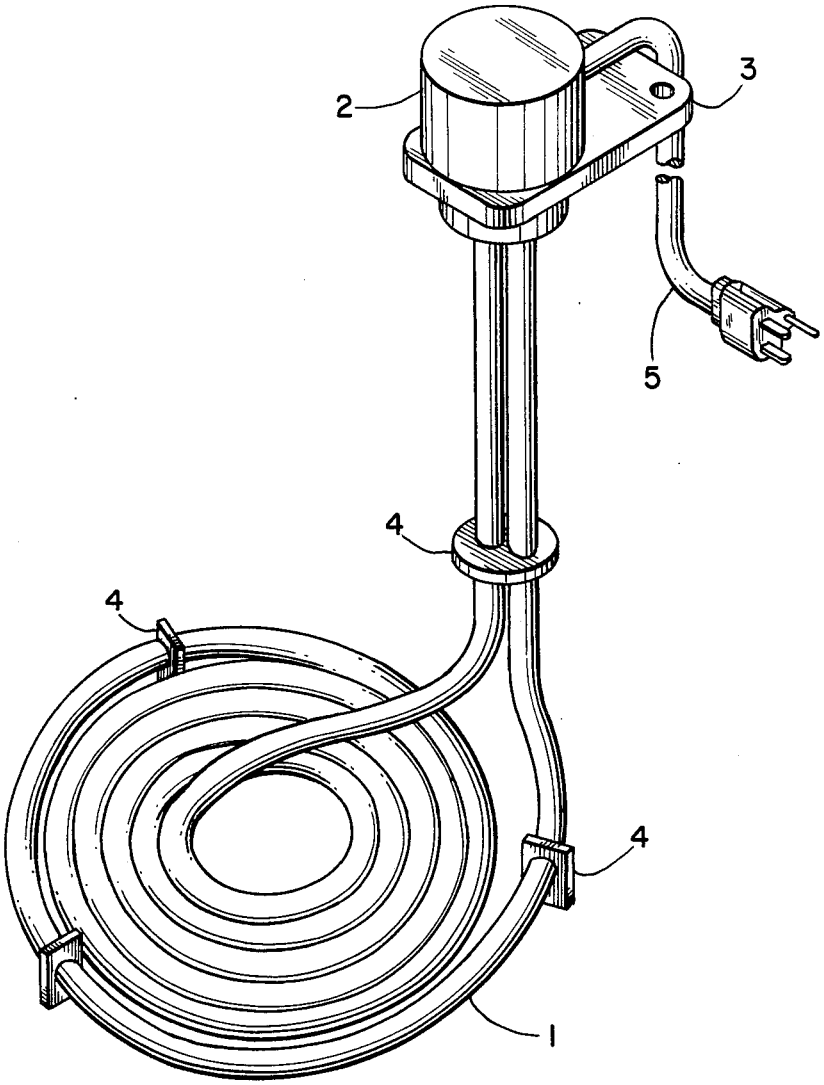
FIG. 1 is a perspective view of the electric immersion heater of the present invention arranged in a L-shaped flat coiled configuration.
Figure 2:
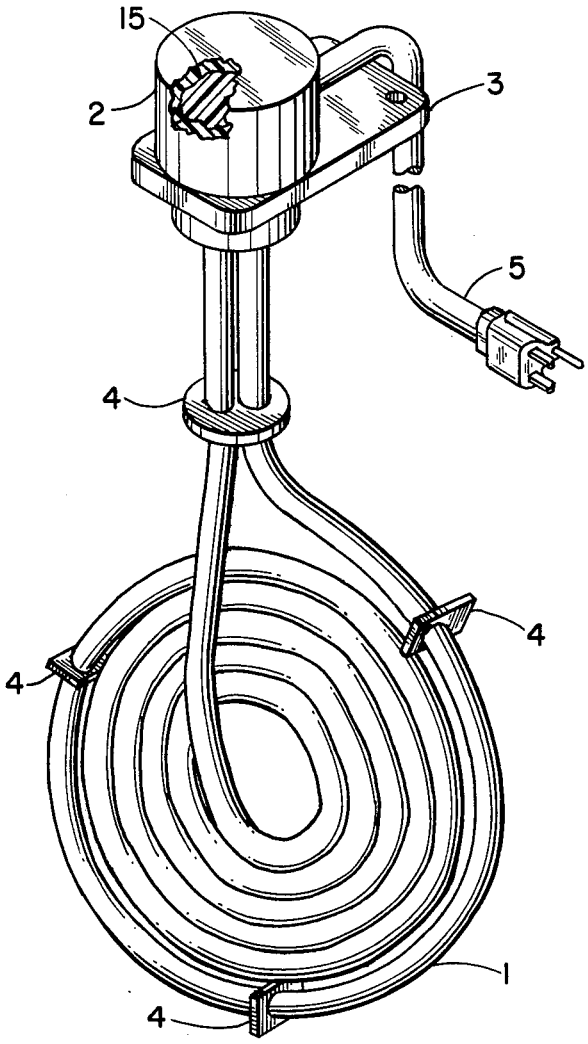
FIG. 2 is a perspective view of the electric immersion heater of the present invention wherein the flat coiled heating element is arranged in a vertical direction so as to provide the heating element along the side of the plating tank. This figure also shows in section potting material 15 which covers and protects all connections within the junction box from corrosive elements.
Figure 3:
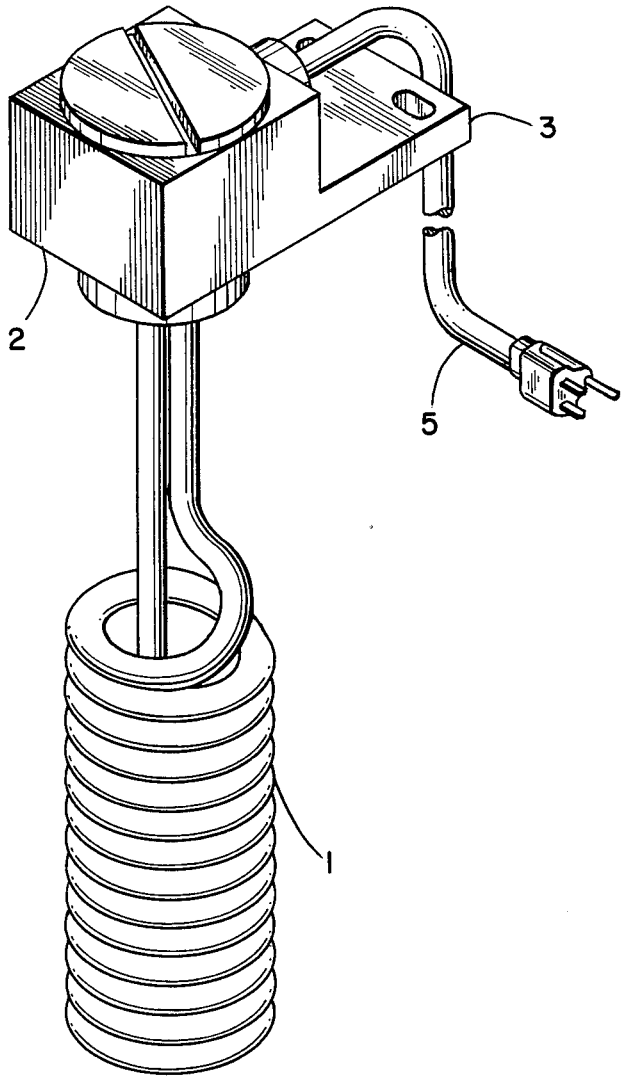
FIG. 3 is a perspective view of another form of the invention wherein the heating coil has been designed in the form of a vertical spiral.
Figure 4:
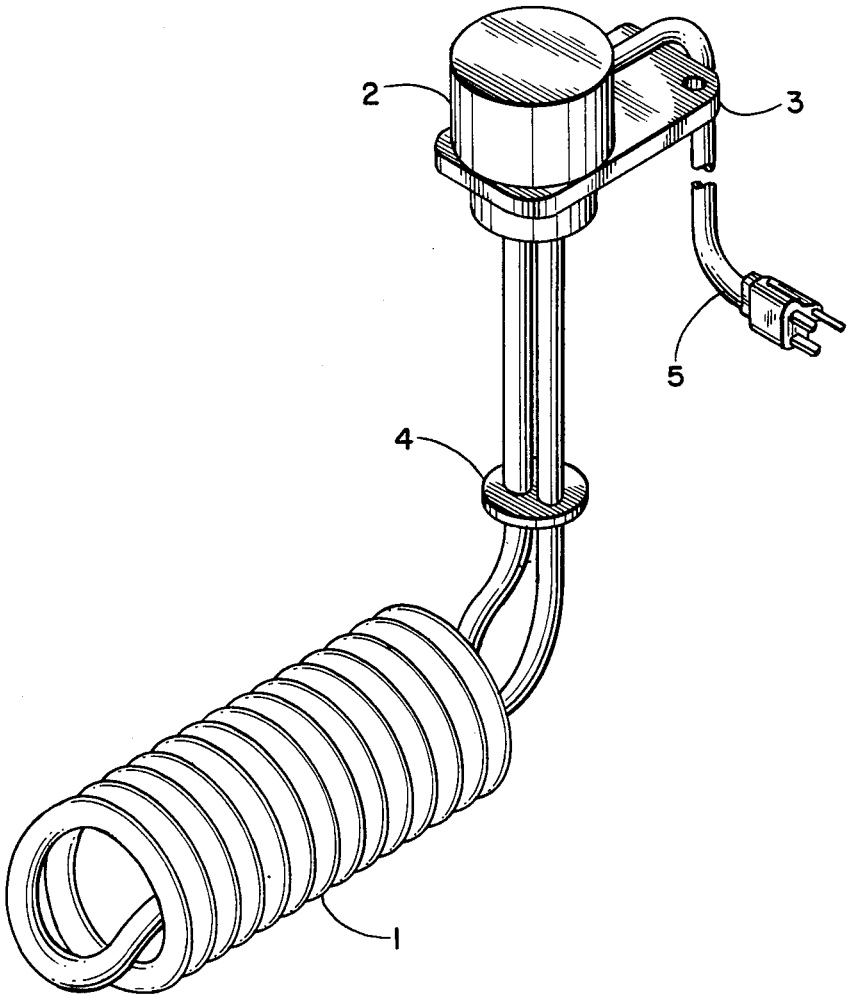
FIG. 4 is similar to FIG. 3 in that the spiral configuration is utilized but in an L-shaped heater.

Referring to FIGS. 1–5 of the drawings, the improved heating tube of the present invention noted generally by the numeral 1 is disposed in a coiled or other configuration. The ends of the heating tube enter a junction box 2 which preferably is made of a plastic inert to the atmosphere and solutions likely to be encountered in the electroplating or other operation in which it is to be used. Attached to or formed as part of the junction box is a mounting means 3 used for mounting the heater to the electroplating tank. In its simplest form the mounting means may be merely a flange which can be attached to the flange on the plating tank. Numerous other mounting means can be utilized with equal facility. The heaters shown in FIGS. 1–5 also utilize spacer elements 4 which serve to either keep the heating coils separated from one another so as to maximize contact with the solution to be heated or are utilized to maintain the heating coil from direct contact with the sides or bottom of the electroplating tank in which it is utilized. Typically, such spacers could be made of any material inert to the processing conditions. Preferably such spacers are made from a corrosion resistant plastic such as polypropylene, polytetrafluoroethylene or the like. Also entering junction box 2 is a wiring harness 5 which contains wiring for a power supply as well as a ground system in case the PTFE tubing is penetrated through damage caused by the tubing being struck with a part being plated or the like.

Figure 5:
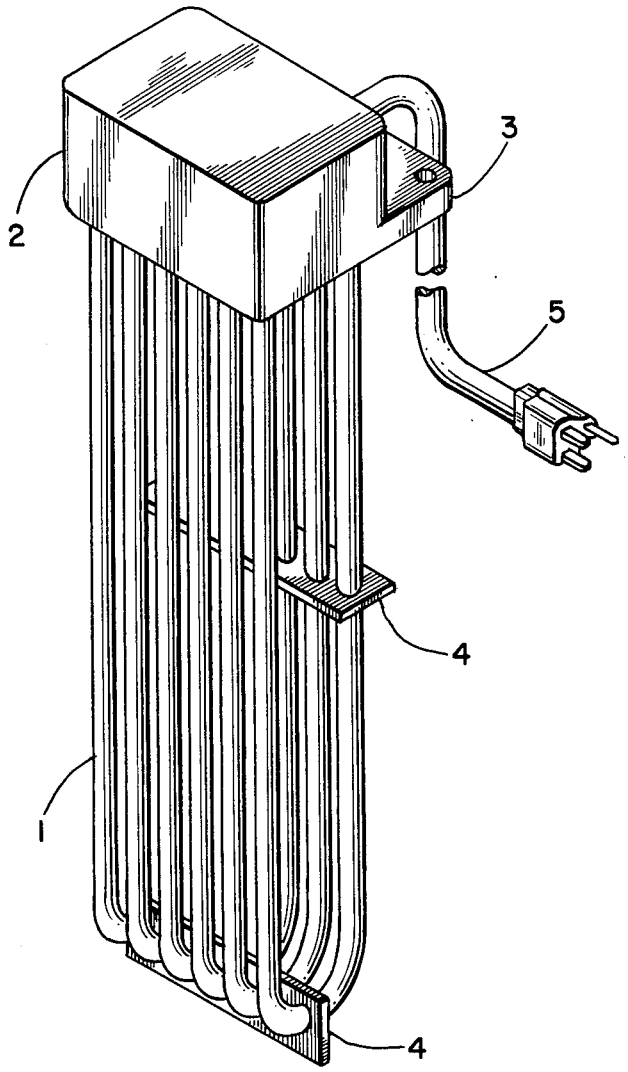
FIG. 5 is another heater utilizing U-shaped heating elements joined in series.
Figure 6:
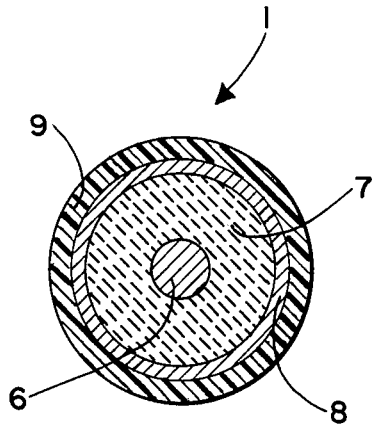
FIG. 6 is a cross-sectional view of the PTFE jacketed heating coil.

FIG. 6 shows the preferred configuration of the heating tube 1 of the instant invention. As shown in this figure, resistance wire 6 is a bare wire having high electrical resistance and is centrally located in the tube. This resistance wire 6 is completely surrounded by a heat-conductive, non-electrical conductive ceramic insulator material. Typically, such a ceramic would be a material such as magnesium oxide powder which has been compressed after assembly. Surrounding the ceramic material is a thin walled metallic tube which has sufficient flexibility to be bent into the various shapes indicated. Preferably this metallic tubing is a material such as stainless steel. Its thickness is preferably in the range of 0.02 to 0.05 inches. The diameter of such a stainless steel tubing should be kept at a minimum in that it merely has to be sufficiently displaced from the resistance wire so as not to interfere with the electrical flow and heating. The metallic tubing 8 is then surrounded by an outer tubular casing 9 formed of resilient electrical insulating material having a low surface coefficient of friction and a high resistance to heat and attacks from acid and alkaline solutions or vapors. The tubular casing 9 is preferably a fluorocarbon polymer, most preferably polytetrafluoroethylene. The PTFE tubular casing 9 is continuous and is of sufficient thickness to give a reasonable amount of abrasion resistance to the heating tube. The diameter of the PTFE tubular casing is such that it tightly adheres to the underlying metallic tubing. In the manufacture of the heating tube, a resistance wire 6 is centrally located in a stainless steel or other metallic tube and said tube is filled with powdered ceramic material such as MgO. After tamping the MgO slightly said MgO maintains a spacing between the resistance wire 6 and the metallic tubing 8 during further assembly and shaping operations. After the tamping of the MgO is completed, the PTFE tubing is slid over the straight length of metallic tubing. When the PTFE tubular casing is in place, the heating tube 1 is then bent into the desired configuration such as shown in the immersion heaters depicted in FIGS. 1–5 or other shapes desired.

Resistance wire 6 is preferably formed of an alloy having high electrical resistance and can be utilized straight or coiled in open pitch arrangement. The resistance wire diameter should be sized to give the desired degree of rigidity for convenience of handling and assembly. In the presently preferred practice of the invention, the resistance wire 6 is formed of an alloy of iron and nickel, iron and chromium, or iron-nickel-chromium. An alloy which has been found particularly satisfactory are those in which the nickel content varies from 20–24% and also contains chromium in the range of 0.1% to 60% by weight and up to 16% iron. Another satisfactory alloy is that sold under the trademark "CHROMEL". However, any suitable electrical resistance wire known in the art having the desired electrical properties may be so employed.

Figure 7:
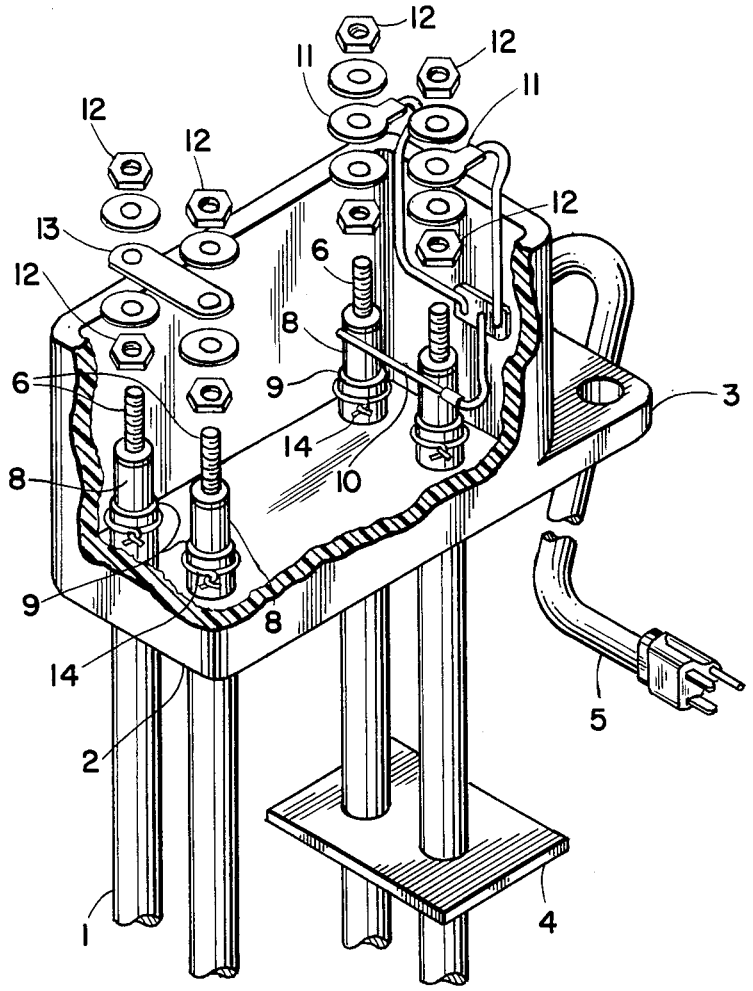
FIG. 7 shows the electrical connections, clamps and grounding found in the junction boxes of the instant invention in a heater of the type shown in FIG. 5.

In shaping the immersion coils of the instant invention, the configuration of the heating tube 1 must be such that each end of each heating tube utilized in the immersion heater must end within the junction box 2. the heaters as depicted in FIGS. 1–4, have but a single heating element. In such case, a wiring harness 5 is connected to each end of the heater element to supply power thereto and a ground wire in the harness is attached to the metal tubing 8. Within the junction box, the PTFE tubular casing 9 is constricted by a clamping means 14 such as shown in FIG. 7 of the drawings, said clamping means as depicted therein is a metal wire which is twisted so as to apply a compressive force entirely around the circumference of the PTFE tubular casing. The wire can be any material, but preferably is stainless steel and it may be coated with an epoxy or other plastic coating which is compatible with and adheres to epoxy resin. After all connections are made within the junction box, epoxy resin or other potting plastic 15 compatible with the system is placed in the junction box so as to pot and protect all connections within the junction box. The epoxy resin completely surrounds the clamping means 14 and bonds tightly to the surface of the clamping means completing a gas tight seal with the PTFE tubular casing 9 to prevent corrosive gases from penetrating up to the potentially corrosive electrical connections and/or heating elements.

FIG. 7 shows in detail the connections made within the junction boxes of the heater types described and shown in FIG. 5 which utilize U-shaped heating elements joined in series. In this FIG. 7, two heating elements are being connected in series. This is merely illustrative as many more such heating units can be joined in series within the scope of the instant invention. For ease of illustration, each end of each heating element is illustrated as being threaded. One positive and one negative pole of each adjacent heating element are interconnected by a series interconnect 13 between the heating tubes. The series interconnect 13 can be made out of any suitable conductive material. Preferably, however, it is a conductive copper and is secured so that there is electrical conductivity between the adjacent heating elements. As illustrated, metal nuts 12 are utilized to fasten the series interconnect between the adjacent heating tubes. The two end U-shaped heating tubes are connected to a wiring harness 5 which supplies the power. Again for ease of description, the wiring harness is shown as being connected to the end heating tubes, i.e. resistance wire 6 by means of metal nuts 12 which clamp electrical connectors 11 to the opposite ends of the interconnected heaters for power supply.

The metal tubing in each heating tube are interconnected and connected to the ground wire in the wiring harness. The preferred method of interconnecting the multi-element heater such as shown in FIG. 7 is to have the stainless steel metal tubing 8 extend above the PTFE tubing so that a ground interconnect 10 can be run between all of the U-shaped heating tubes in the heater. Preferably, this ground interconnect is merely a conductive metal rod which is welded to the metal tubing or by other means kept in electrical contact with each such metal tubing 8 within the heater. The ground wire from the wiring harness 5 is the placed in electrical contact with the ground interconnect 10 to effectively ground each and every heating element in the heater. Each end of each heating element lies wholly within junction box 2. Clamping means 14 are placed around the PTFE tubular casing adjacent each end of each heating element and tightened to effect a compressive force completely around the circumference of the PTFE tubular casing to effect a gas tight seal between said clamping means and said PTFE tubular casing. As indicated earlier, the clamping means can be something as simple as metallic wire which is twisted and it can be metallic wire which has been precoated with plastic material which is compatible from an adhesive standpoint with epoxy resin or other potting material to be used in potting all of the electrical connections within the junction box or it can be a metallic clamp such as an airplane clamp.

All of the prior descriptions have been with respect to a grounded heater of various types. The instant invention can also be utilized on ungrounded heaters. Basically, such heaters could be as described herein without the presence of the metallic tube. In such cases the clamping means 14 would either utilize the magnesium oxide insulating material or the heating element itself has a bearing surface on which the clamping means 14 is tightened. Of course if the conductor portion of the heating element is at elevated temperatures at such point it is preferred to put in a metal sleeve which would surround the insulating material, i.e. the ceramic insulator 7 and would fit within the end of the PTFE tubular casing to act as a bearing surface with for the clamping means. As described heretofore, resistance wire 6 runs the full length of the PTFE tubular casing. However, it should be understood by those skilled in the art that the actual resistance wire might only be present in the portions of the heaters which are in direct contact with the materials to be heated. Particularly, a conductor could run part way down the PTFE tubular casing and be connected to the resistance wire at a point below the surface of the liquid in the plating baths or the like and no heat would be lost to the atmosphere directly from the heater since the heaters would be cold or relatively so in the areas not containing the resistance wiring. This would be in the portions of the heating tubes out of the solution being heated.

Those of ordinary skill in the art will recognize that the invention as described above is capable of modification and variation and is therefore limited only by the following claims.

What is claimed is:

1. A flexible heating assembly for immersion heating of a liquid in a container, said assembly comprising:

a heating tube having (a) a heating element being formed of bare wire having a high electrical resistance, (b) a heat conductive, non-electrically conductive ceramic insulator surrounding said heating element, (c) a thin-walled metallic tubing surrounding said ceramic insulator, and (d) an outer tubular casing formed of resilient electrical insulating material having a low surface coefficient of friction and a high resistance to heat and attacks by acid and alkaline solutions or vapors, said outer tubular casing being in direct contact with said thin-walled metallic tubing; and an associated non-corrosive junction box located without the liquid to be heated, the ends of said heating tube terminating within said junction box and having power supply means connected to said heating element and a grounding means connected to said metallic tubing within said junction box, clamping means surrounding each end of said outer tubular casing within said junction box, said clamping means applying a compressive force continuously around said outer tubular casing so as to prevent any corrosive liquid or vapors from penetrating between said outer tubular casing and said clamping means, and the remaining interior of the junction box being filled with a potting material which covers all electrical connections, the ends of the outer tubular casing and clamping means, said clamping means being receptive to the potting material so that a gas-tight seal is effected between the outer surface of the clamping means and the potting material.

2. A flexible heating assembly as defined in claim 1 wherein said thin-walled metallic tubing is stainless steel and said outer tubular casing is polytetrafluoroethylene.

3. A flexible heating assembly as defined in claim 2 wherein said clamping means consists of wire which is placed around said outer tubular casing and thereafter twisted to apply a continuous compressive force against said casing.

4. A flexible heating assembly as defined in claim 3 wherein said ceramic insulator is MgO and said heating element is an iron-nickel-chromium resistance wire containing from 20–24% nickel and 0.1 to 60% chromium.

5. A flexible heating assembly as defined in claim 4 wherein said potting material is an epoxy resin.

6. A flexible heating assembly for immersion heating of a liquid in a container, said assembly comprising:

a heating tube having (a) a heating element being formed of bare wire having a high electrical resistance, (b) a heat conductive, non-electrically conductive ceramic insulator surrounding said heating element, and (c) an outer tubular casing formed of resilient electrical insulating material having a low surface coefficient of friction and a high resistance to heat and attacks by acid and alkaline solutions or vapors;

an associated non-corrosive junction box located without the liquid to be heated, the ends of said heating tube terminating within said junction box and having power supply means connected to said heating element, clamping means surrounding each end of said outer tubular casing within said junction box, and a thin-walled metallic tubing surrounding said ceramic insulator at the point where a clamping means surrounds an outer tubular casing, said outer tubular casing being in direct contact with said thin-walled metallic tubing, said clamping means applying a compressive force continuously around said outer tubular casing so as to prevent any corrosive liquid or vapors from penetrating between said outer tubular casing and said clamping means, and the remaining interior of the junction box being filled with a potting material which covers all electrical connections, the ends of the outer tubular casing and clamping means, said clamping means being receptive to the potting material so that a gas-tight seal is effected between the outer surface of the clamping means and the potting material.

7. A flexible heating assembly as defined in claim 6 wherein said thin-walled metallic tubing is stainless steel and said outer tubular casing is polytetrafluoroethylene.

8. A flexible heating assembly as defined in claim 7 wherein said clamping means consists of wire which is placed around said outer tubular casing and thereafter twisted to apply a continuous compressive force against said casing.

9. A flexible heating assembly as defined in claim 8 wherein said ceramic insulator is MgO and said heating element is an iron-nickel-chromium resistance wire containing from 20–24% nickel and 0.1 to 60% chromium.

10. A flexible heating assembly as defined in claim 9 wherein said potting material is an epoxy resin.

* * * * *